US011654472B2

(12) United States Patent
Ihara

(10) Patent No.: US 11,654,472 B2
(45) Date of Patent: May 23, 2023

(54) FORMING AND PROCESSING METHOD

(71) Applicant: TOYOTA JIDOSHA KABUSHIKI KAISHA, Toyota (JP)

(72) Inventor: Tomoaki Ihara, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/647,081

(22) Filed: Jan. 5, 2022

(65) Prior Publication Data

US 2022/0219220 A1 Jul. 14, 2022

(30) Foreign Application Priority Data

Jan. 13, 2021 (JP) ..... JP2021-003691

(51) Int. Cl.
*B21D 28/26* (2006.01)
*B21D 37/16* (2006.01)

(52) U.S. Cl.
CPC ..... *B21D 28/26* (2013.01); *B21D 37/16* (2013.01)

(58) Field of Classification Search
CPC ..... B21D 28/24; B21D 28/26; B21D 28/34; B21D 37/16; B21D 37/12
See application file for complete search history.

(56) References Cited

U.S. PATENT DOCUMENTS 2,294,413 A * 9/1942 Marshall ..... C21D 1/10 266/127
5,938,964 A 8/1999 Takita et al.
6,742,374 B2 * 6/2004 Ozawa ..... B21D 22/022 72/364
2009/0252904 A1 * 10/2009 Weinberger ..... C21D 9/08 428/34.1
2013/0000375 A1 1/2013 Okada et al.
2017/0144208 A1 * 5/2017 Mikami ..... C21D 1/42
2017/0333971 A1 11/2017 Denks et al.
2020/0078853 A1 3/2020 Denks et al.
2020/0239974 A1 7/2020 Ihara et al.
2020/0245414 A1 7/2020 Sakoda et al.

FOREIGN PATENT DOCUMENTS

DE 10 2011 121 904 A1 6/2013
DE 10 2014 016 614 A1 5/2016
EA 020748 B1 1/2015
JP 11-172325 A 6/1999
JP 2005-209608 A 8/2005
JP 2014-224298 A 12/2014
JP 2020-116635 A 8/2020
JP 2020-119807 A 8/2020
RU 2 701 810 C2 10/2019
RU 2 725 268 C1 6/2020
SU 109967 A1 11/1957
SU 875650 A1 10/1981

* cited by examiner

*Primary Examiner* — Teresa M Ekiert
(74) *Attorney, Agent, or Firm* — Sughrue Mion, PLLC

(57) ABSTRACT

Only a punched end is locally heated while a current value of a heating electrode is stabilized during heating. A forming and processing method includes punching a steel plate, and disposing a heating coil so as to face an end face of a punched end punched in the punching in a non-contact manner along the end face of the punched end and applying a current to the heating coil to generate an induced electromotive force in the steel plate, thereby heating the end face.

8 Claims, 19 Drawing Sheets

HOLE-EXPANDING FORMING PART

FLANGE FORMING PART

FORMING AND PROCESSING METHOD

CROSS REFERENCE TO RELATED APPLICATIONS

This application is based upon and claims the benefit of priority from Japanese patent application No. 2021-003691, filed on Jan. 13, 2021, the disclosure of which is incorporated herein in its entirety by reference.

BACKGROUND

The present disclosure relates to a method for forming and processing a steel plate.

Stretch-flange crack is one of the problems in press forming of High Tensile Strength Steel. This stretch-flange crack is caused by residual strain on a sheared end face such as a punched end in a punching step. As a method for reducing the residual strain, a heating method has already been known. As a method for heating the residual strain part, a forming and processing method for bringing a heating electrode into contact with the punched end, and electrically heating the punched end to remove the residual strain is known (e.g., see Japanese Unexamined Patent Application Publication No. 2020-116635).

SUMMARY

However, according to one embodiment of the above forming and processing method, the heating electrode is brought into direct contact with the punched end. For this reason, when the heating electrode is repeatedly brought into contact with the punched end for mass production or the like, the heating electrode is worn. The wear of the heating electrode causes a change in an area where the heating electrode is brought into contact with the punched end, and thus a current value of the heating electrode during heating is not stabilized. On the other hand, according to another embodiment of the above forming and processing method, the punched end is sandwiched between a pair of heating electrodes in a non-contact manner to electrically heat the punched end. In this case, the heating electrode will not be worn, but it causes a problem that a heating range is extended beyond the vicinity of the punched end.

The present disclosure has been made to solve such a problem and an object of the present disclosure to provide a forming and processing method capable of locally heating only a punched end while stabilizing a current value of the heating electrode during heating.

An example aspect of the present disclosure for achieving the above object is a forming and processing method including:

punching a steel plate; and disposing a heating coil so as to face an end face of a punched end punched in the punching in a non-contact manner along the end face of the punched end and applying a current to the heating coil to generate an induced electromotive force in the steel plate, thereby heating the end face.

In this example aspect, a diameter of the heating coil may be larger than a thickness of the steel plate.

In this example aspect, a hole may be formed in the steel plate by punching the steel plate in the punching, and in the heating, an end face of the hole may be heated while the heating coil is inserted into the hole.

In this example aspect, in the punching, an open punched end including an end face partially opened may be formed in the steel plate by punching the steel plate, and in the heating, the heating coil may be disposed so as to face an end face of the open punched end along the end face of the open punched end, and then the end face of the open punched end may be heated.

In this example aspect, in the heating, the steel plate punched in the punching may be disposed on a heating jig and then heated by the heating coil, and the heating jig may include a positioning guide for positioning the steel plate punched in the punching at a predetermined position, and the heating coil for heating the end face of the punched end of the steel plate positioned by the positioning guide.

In this example aspect, the heating may be carried out during an optional step in a press machine.

This example aspect further includes: forming a stretch-flange at the punched end.

The heating may be carried out in idling, and in the idling, a conveying pitch when the steel plate is conveyed from the punching to the forming of the stretch-flange may be adjusted.

In this example aspect, in the press machine, at least the punching and the idling may be continuously carried out at a predetermined conveying pitch while the steel plate formed product is continuously conveyed by gripping parts, and the idling may be replaced with the heating by disposing the heating jig at a position corresponding to the idling.

In this example aspect, the number of windings of the heating coil may be three.

In this example aspect, a center axis of the heating coil may be inclined at a predetermined angle with respect to a center axis of the end face of the punched end of the steel plate, and the predetermined angle $\theta$ may be set within a range of $-15° \leq \theta \leq 15°$.

In this example aspect, the heating coil may be formed as a single pipe-like coil wire, and a cooling liquid may flow in the heating coil.

In this example aspect, the heating coil may be formed in a loop shape along an end face formed on the steel plate, and end parts of the loop shape overlap each other.

According to the present disclosure, it is possible to provide a forming and processing method capable of locally heating only a punched end while stabilizing a current value of a heating electrode during heating.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

First Embodiment

Although the present disclosure is described below through the embodiments of the disclosure, the claimed disclosure is not limited to the following embodiments. In addition, not all of the configurations described in the embodiments are indispensable as means for solving the problems.

Figure 1:
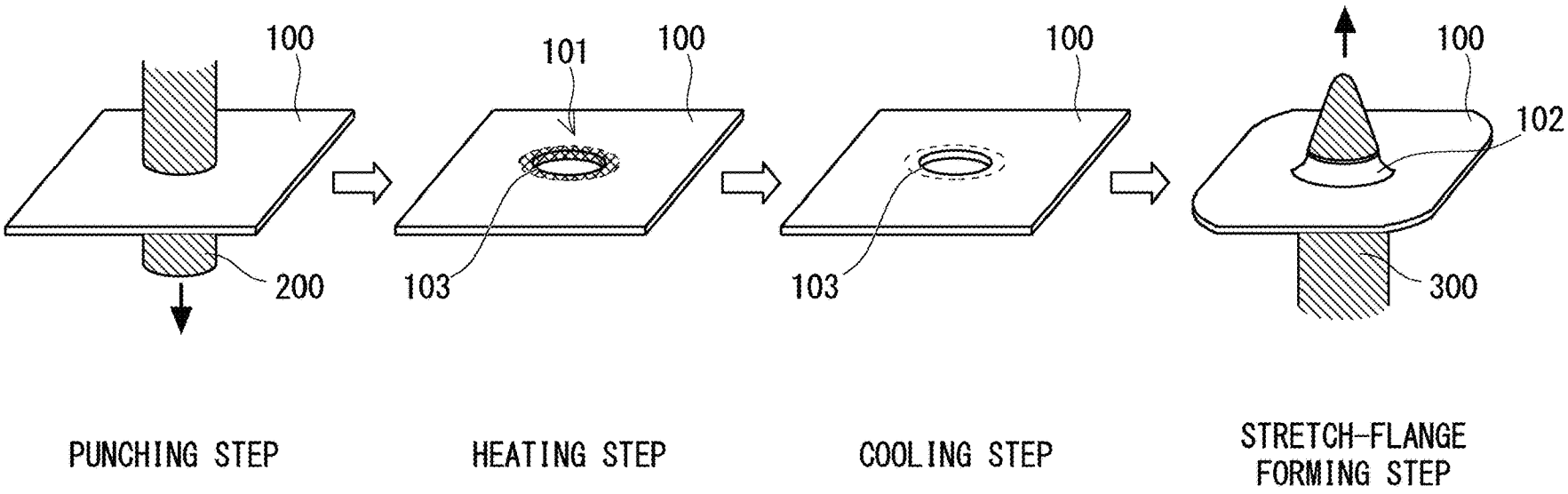
FIG. 1 is a schematic diagram schematically showing steps of a forming and processing method according to an embodiment.

FIG. 1 is a schematic view schematically showing steps of a forming and processing method according to this embodiment. In the forming and processing method described below, a hole 101 is formed in a steel plate 100 as a workpiece, and a flange 102 is formed by deforming a peripheral edge of the hole 101.

The forming and processing method according to this embodiment includes, for example, as shown in FIG. 1, a punching step of punching the steel plate 100, a heating step of heating a punched end 103, a cooling step of cooling the heat generated in the heating step, and a stretch-flange forming step of forming the flange 102 for the punched end 103.

The punching step is a step of punching the steel plate 100 fixed to a punching die (not shown) with a blanking punch 200. The heating step, which will be described later in detail, is a step of heating the punched end 103 formed in the punching step.

Figure 2:
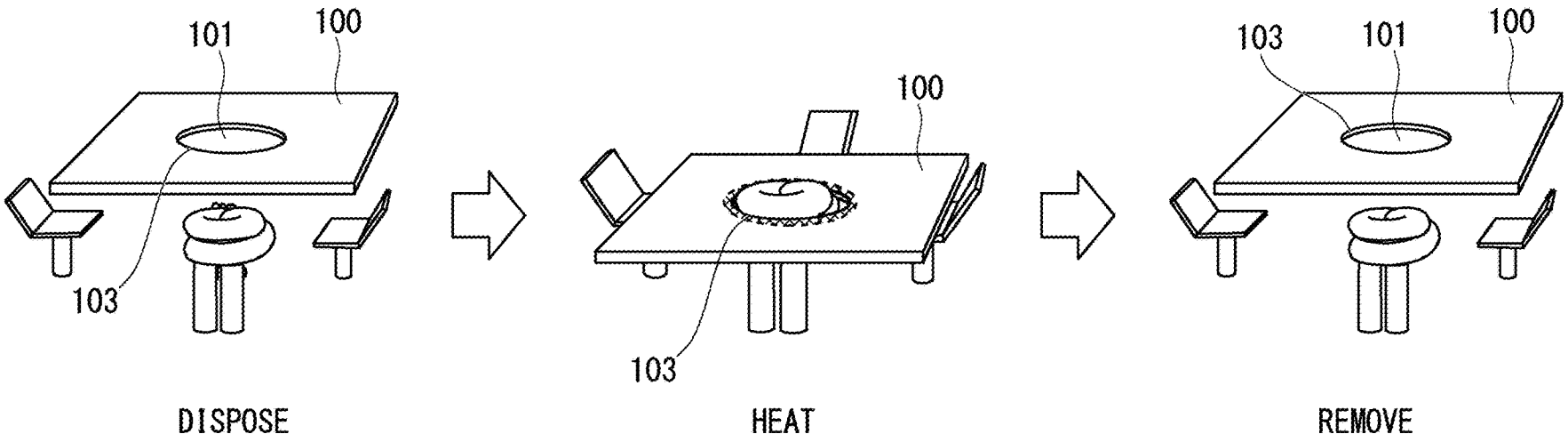
FIG. 2 is a schematic diagram schematically showing processing steps.

In the heating step, as shown in FIG. 2, the punched steel plate 100 is disposed on a heating jig. Then, high-frequency induction heating is performed on the punched end 103 of the steel plate 100. After heating the punched end 103 of the steel plate 100, the steel plate 100 is removed from the heating jig.

As shown in FIG. 1, the cooling step is a step of cooling the heat of the punched end 103 heated in the heating step. Specifically, the steel plate 100 is left for a fixed time in a normal temperature environment. The stretch-flange forming step (burring step) is a step of inserting a flange die 300 into the hole 101 and plastically deforming the peripheral edge of the hole 101 to form the flange 102.

Residual strain generated at the peripheral edge of the hole 101 in the punching step is removed in the heating step. Since the stretch-flange forming step is introduced after the steel plate is cooled, damage caused to the flange die 300 can be reduced more than that caused to the flange die 300 when the residual strain is removed from the steel plate 100 in a heated state. In particular, in this embodiment, as will be described later, since the punched end 103 can be locally heated, the residual strain can be satisfactorily removed, and the heating efficiency is also improved.

According to one embodiment of the forming and processing method of the related art, the heating electrode is brought into direct contact with the punched end. Therefore, when the heating electrode is repeatedly brought into contact with the punched end for mass production or the like, the heating electrode is worn. The wear of the heating electrode causes a change in an area where the heating electrode is brought into contact with the punched end, and thus a current value of the heating electrode during heating is not stabilized. On the other hand, according to another embodiment of the above forming and processing method, the punched end is sandwiched between a pair of heating electrodes in a non-contact manner to electrically heat the punched end. In this case, the heating electrodes will not be worn, but it causes a problem that the heating range extends beyond the vicinity of the punched end.

Figure 3:
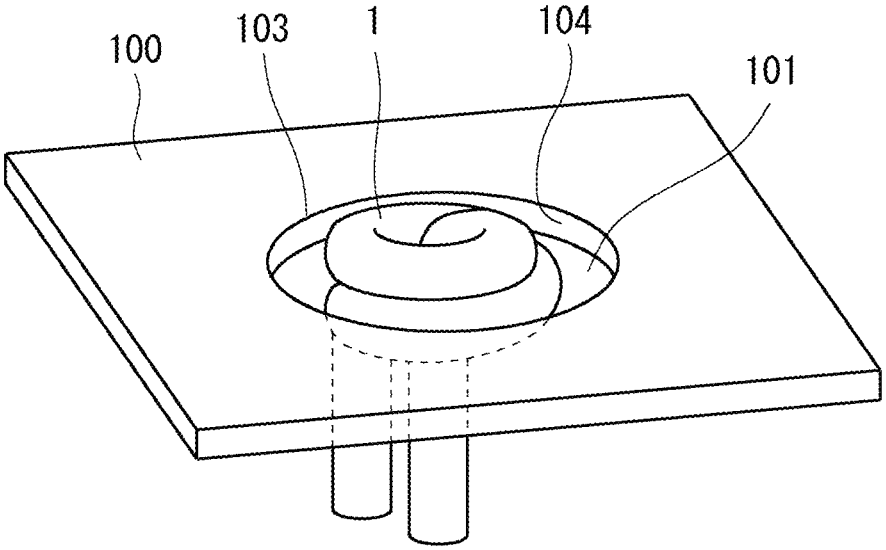
FIG. 3 is a perspective view of a heating coil according to the embodiment.

On the other hand, the forming and processing method according to this embodiment includes, for example, as shown in FIG. 3, a heating step of disposing a heating coil 1 so as to face an end face 104 of the punched end 103 punched in the punching step in a non-contact manner along the end face 104, and applying a current to the heating coil 1 to generate an induced electromotive force in the steel plate 100, thereby heating the end face 104.

Figure 4:
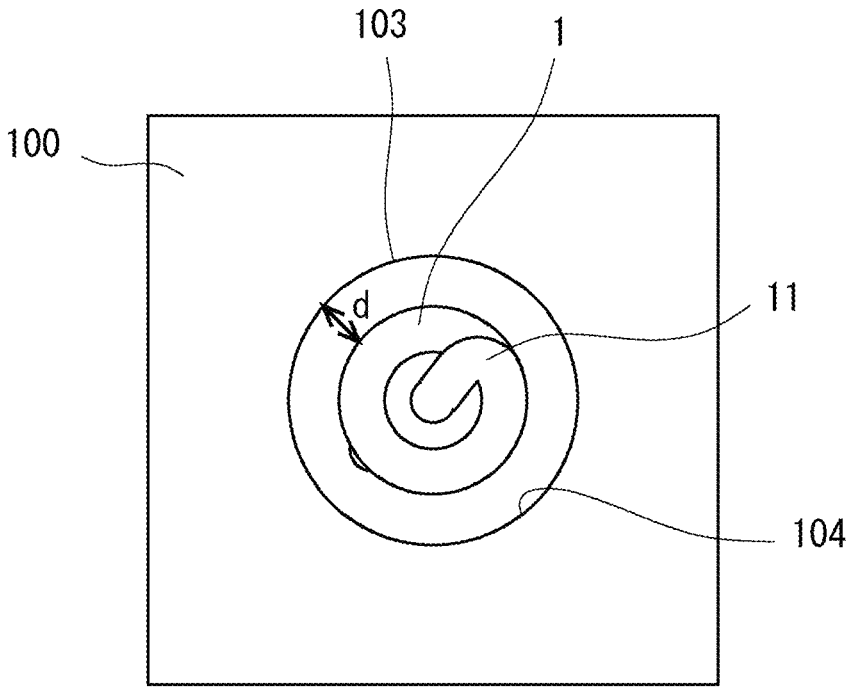
FIG. 4 is a top view of the heating coil shown in FIG. 3 as viewed from above.

FIG. 3 is a perspective view of a heating coil according to this embodiment. FIG. 4 is a top view of the heating coil shown in FIG. 3 as viewed from above. The heating coil 1 is disposed in a non-contact manner with the end face 104 of the punched end 103 of the steel plate 100 to heat the end face 104. Thus, the heating coil 1 as described above will not be worn, and thus the current value of the heating coil 1 during heating can be stabilized.

Further, it is not necessary to heat the steel plate from the vertical direction while holding the steel plate as in the related art, and the heating coil 1 can be disposed to heat the end face 104 of the punched end 103 of the steel plate 100.

Further, the heating coil 1 is disposed so as to face the end face 104 of the punched end 103 along the end face 104 of the punched end 103, and an induced electromotive force is generated in the steel plate 100. Thus, an induced current can be generated along the end face 104 of the punched end 103, and only the end face 104 can be locally heated. Since only the end face 104 of the punched end 103 where the stretch-flange is to be formed can be locally heated, it is possible to prevent or minimize the whole steel plate 100 from being softened.

According to the heating step of this embodiment, the heating range is not extended from the vicinity of the punched end 103, but is limited to a range extended outward from the punched end 103 by about 1 to 2 mm. Thus, only the vicinity of the punched end 103 can be locally heated.

The punched end 103 of the steel plate 100 is formed in a circular hole shape, for example, as shown in FIG. 4. As described above, when the punched end 103 has a hole shape, the induced current flowing through the end face 104 becomes a connected loop shape, so that the heating can be performed more efficiently.

When the punched end 103 of the steel plate 100 is formed in a circular hole shape, as shown in FIG. 4, the heating coil 1 is formed in a substantially circular shape along this hole shape, and inserted and disposed in the hole shape. The heating coil 1 heats the end face 104 of the hole in this state. The hole shape of the punched end 103 is not limited to a circular shape, and instead may be, for example, an elliptical shape, a square shape, a triangular shape, or the like.

Figure 5:
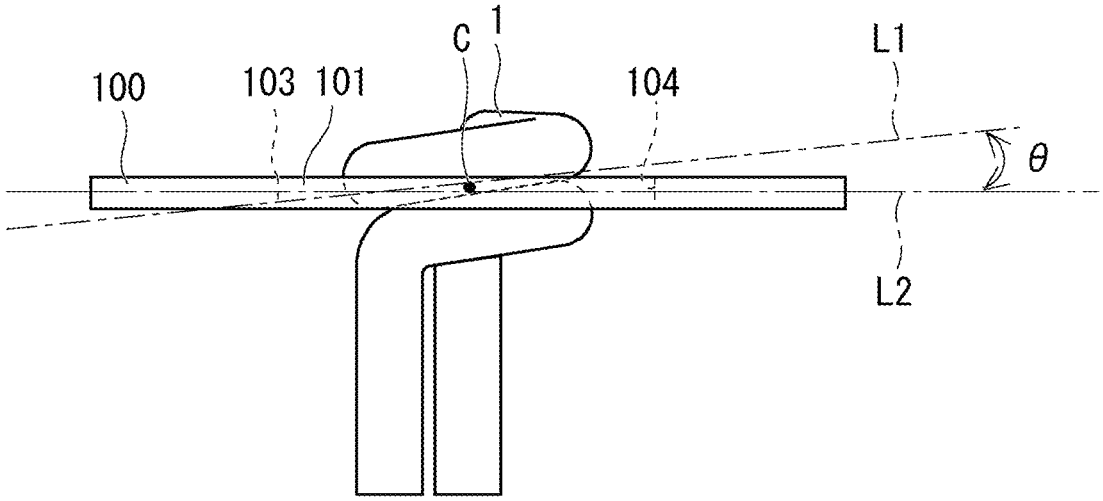
FIG. 5 is a side view of a heating coil and a steel plate viewed from side.

FIG. 5 is a side view of the heating coil and the steel plate as viewed from the side. A center axis L1 of the heating coil 1 may be inclined at a predetermined angle θ with respect to a center axis L2 of the end face 104 of the punched end 103 of the steel plate 100. The predetermined angle θ is preferably set within the range of $-15° \leq \theta \leq 15°$. The smaller an absolute value of θ is, the more preferable. That is, the center axis L1 of the heating coil 1 is most preferably parallel (θ=0) to the center axis L2 of the end face 104 of the punched end 103 of the steel plate 100.

Figure 6:
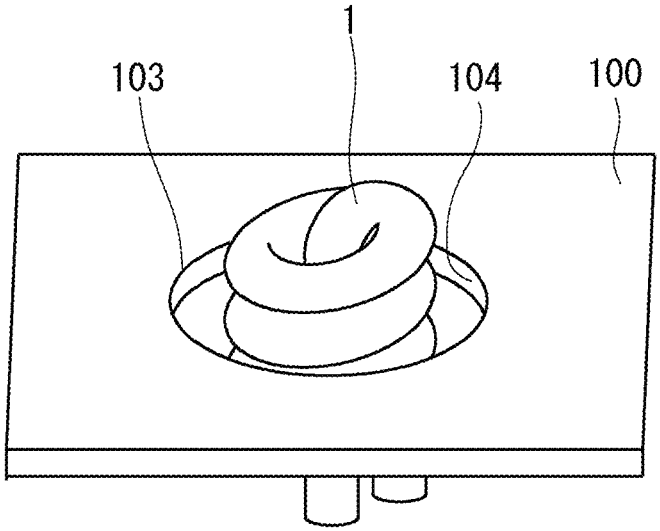
FIG. 6 shows an example of a configuration of a heating coil with three windings.

As shown in FIG. 5, the number of windings of the heating coil 1 is two. However, as shown in FIG. 6, the number of windings of the heating coil 1 is most preferably three. In this manner, not only the entire end face 104 of the punched end 103 can be heated in a short time with an optimum inductance, but also heat conduction in a longitudinal direction of the steel plate 100 can be effectively prevented or minimized, and only the vicinity of the end face 104 of the punched end 103 can be locally heated more appropriately.

Figure 7:
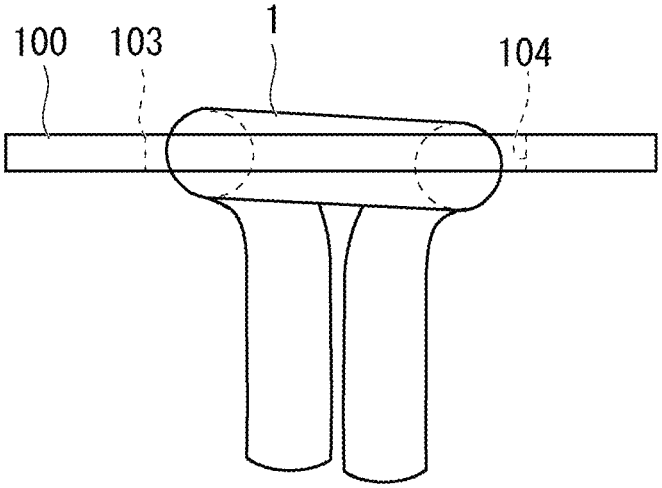
FIG. 7 shows an example of a configuration of a heating coil with one winding.

The number of windings of the heating coil 1 may be one or four or more. By increasing the number of windings of the heating coil 1, the inductance of the heating coil 1 can be further increased, the magnetic field can be improved, and a heating time can be shortened. When the number of windings of the heating coil 1 is one as shown in FIG. 7, the diameter of the heating coil 1 is preferably larger than a thickness of the steel plate 100. In this way, the entire end face 104 of the punched end 103 can be effectively heated.

As shown in FIG. 5, it is more preferable that a center C of the heating coil 1 and the center C of the hole 101 of the steel plate 100, as viewed from the side, coincide with each other. However, the heating coil 1 may be slightly shifted upward or downward. The heating coil 1 is preferably shifted upward rather than downward.

The heating coil 1 is formed as a single coil wire, but for example, a bundle of a plurality of thin wires may be formed as a single coil wire. It is more preferable in terms of cooling efficiency that the heating coil 1 be formed, for example, as a single pipe-like coil wire and a cooling liquid is allowed to flow through the coil wire.

As shown in FIG. 4, the heating coil 1 preferably passes through the entire periphery of the punched end 103 of the steel plate 100 by making a circular end 11 overlap each other. In this manner, the induced electromotive force can be sufficiently generated for the entire circumference of the punched end 103 of the steel plate 100. Note that it is preferable that the heating coil 1 penetrate at least ¾ or more of the line length of the punched end 103 of the steel plate 100.

A distance d between the heating coil 1 and the end face 104 of the punched end 103 of the steel plate 100 is preferably two times or less of the diameter of the heating coil 1 (FIG. 4). The distance d between the heating coil 1 and the end face 104 of the punched end 103 of the steel plate 100 is preferably as small as possible within a range where no spark occurs (e.g., the distance d is greater than or equal to the thickness of the steel plate 100). The heating coil 1 may be covered with an insulator. In this case, the heating coil 1 covered with the insulator may be in contact with the end face 104 of the punched end 103 of the steel plate 100.

Figure 8:
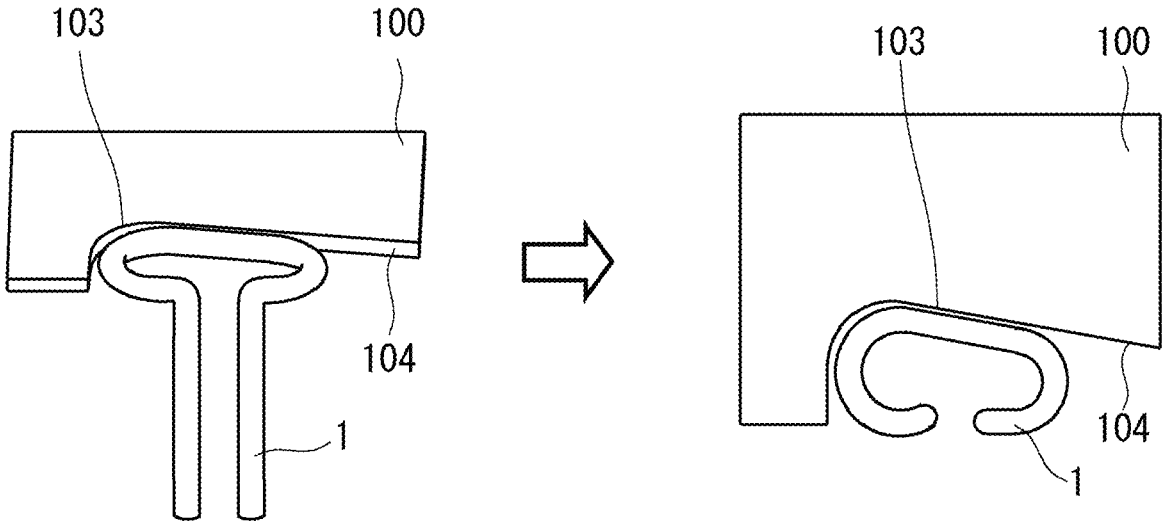
FIG. 8 shows a punched end with an open end face.

The punched end 103 of the steel plate 100 may be, for example, an open punched end 103 in which a part of the end face 104 is opened, as shown in FIG. 8. The heating coil 1 is formed in a substantially elliptical shape along the shape of the end face 104 of the open punched end 103, and is disposed to face the end face 104 of the open punched end 103 along the end face 104 of the open punched end 103.

Figure 9:
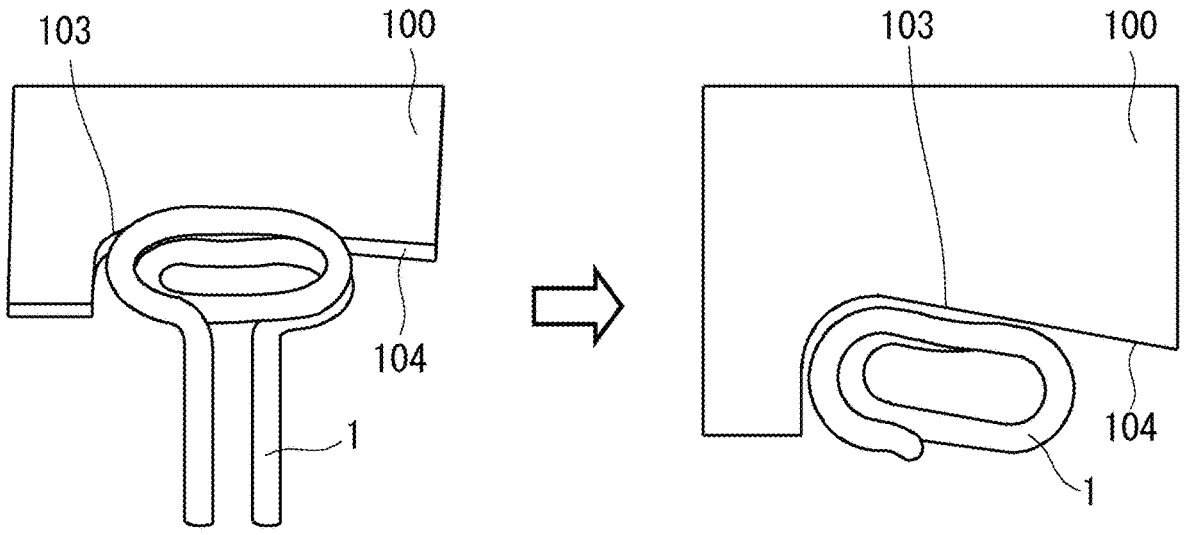
FIG. 9 shows an example of a configuration of a heating coil with two windings.

Further, also in the structure of the open punched end 103, the number of windings of the heating coil 1 may be plural in order to increase the inductance of the heating coil 1. FIG. 9 shows a configuration example of the heating coil with two windings.

The heating temperature of the heating coil 1 is adjusted, for example, so that the punched end 103 becomes 200° C. or more and less than an Ac1 point. If the heating is performed within this temperature range, the residual strain can be removed appropriately. In particular, when the steel plate 100 is heated to the Ac1 point or higher, austenite transformation occurs in the steel plate 100. When such a steel plate is cooled by air, the steel plate is softened and its strength decreases, and when such a steel plate is quenched with running water or the like, hardness increases and moldability in the stretch-flange forming step decreases. For this reason, it is preferable to keep the temperature of the steel plate 100 below the Ac1 point.

Next, the effect of the forming and processing method according to this embodiment will be described in detail. In this embodiment, the test was conducted under the following conditions.

Figure 10:
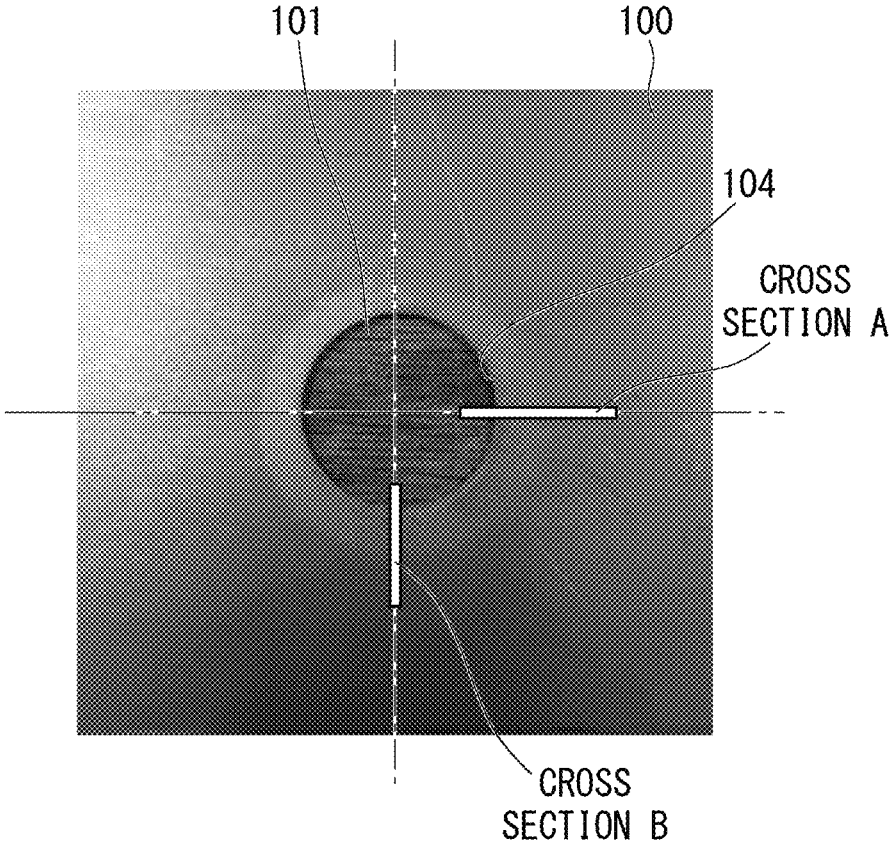
FIG. 10 shows a hole punched in a steel plate by pressing.

As shown in FIG. 10, a hole 101 having a diameter of 30 mm was formed in the center of a steel plate JAC 1180 having a thickness of 1.2 mm (a galvanized steel plate with tensile strength of about 1180 MPa) by pressing. The heating coil 1 was formed by forming a loop shape of a circle having a diameter of 20 mm with a pipe having a diameter of 5 mm. The heating coil 1 thus formed was inserted into the punched hole 101. The heating coil 1 was disposed substantially parallel to the steel plate 100.

A high-frequency current of 150 to 400 kHz was applied to the heating coil 1 for one second by feedback control so that temperature of the end face 104 of the hole 101 (the punched end 103) which is a part to be heated became 600° C.

A Vickers hardness test was conducted on the end face 104 of the hole 101 heated under the above conditions. In this test, the following measurements were made.

A position 0.1 mm from a surface layer in the direction of the plate surface was measured. A total of ten points were measured from the end face 104 to a 2 mm depth at 0.2 mm intervals. A total of 16 points were measured from the end face 104 to 2 to 10 mm depths at 0.5 mm intervals. A load of 300 g was applied.

Figure 11:
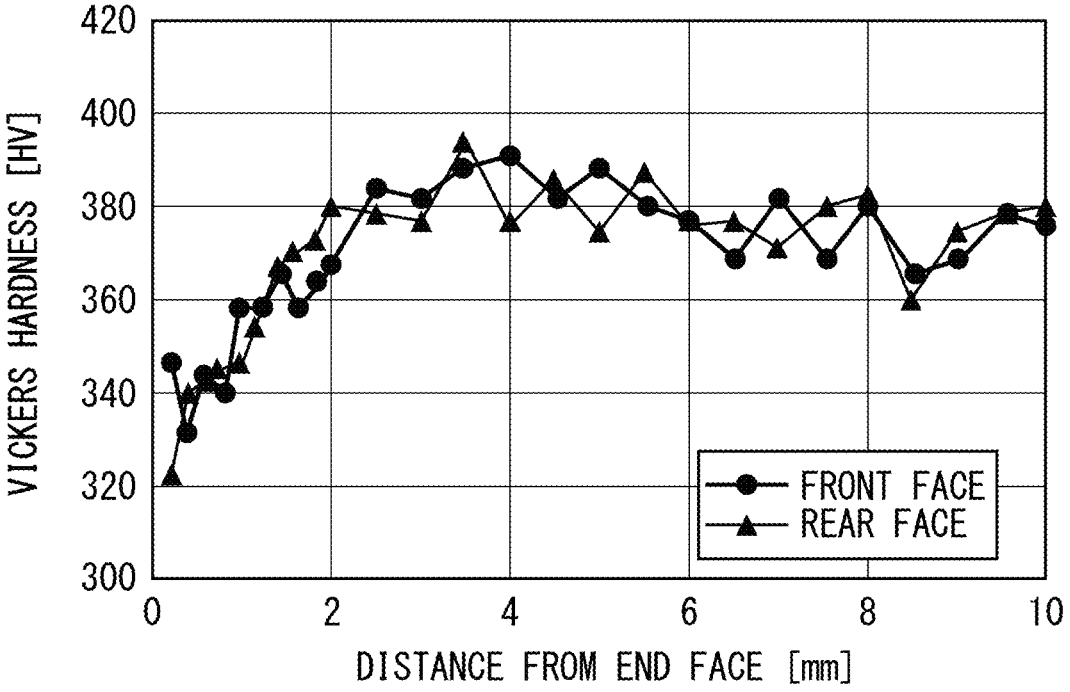
FIG. 11 shows a test result of the Vickers hardness test.
Figure 12:
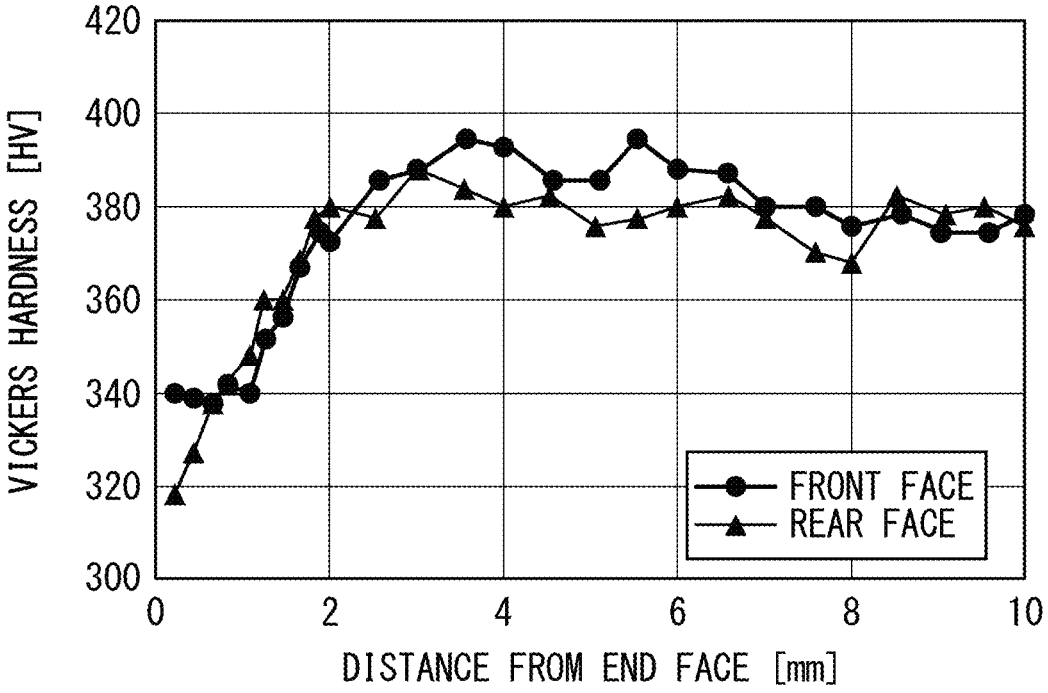
FIG. 12 shows a test result of the Vickers hardness test.

FIGS. 11 and 12 show a test result of the Vickers hardness test described above. FIG. 11 shows the hardness near the edge of the hole 101 in a cross section A, and FIG. 12 shows the hardness near the edge of the hole 101 in a cross section B. In FIGS. 11 and 12, the vertical axis represents the Vickers hardness [HV], the horizontal axis represents the distance [mm] from the end face 104, and the Vickers hardness [HV] of the rear face and the front face of the steel plate 100.

As shown in FIGS. 11 and 12, in the cross sections A and B, the distance from the end face 104 increases from 0 to 2 mm, and the Vickers hardness increases gradually from about 320 HV. When the distance from the end face 104 exceeds 2 mm, the Vickers hardness is about 380 HV.

In addition, the changes in the Vickers hardness of the cross section A was almost the same as that of the cross section B, and there was no difference between the cross sections. That is, it can be considered that only the part (the part near the hole) 2 mm from the end face 104 along a circumferential direction is uniformly heated and softened.

According to the forming and processing method of this embodiment, it can be seen that strength of a base material is maintained at the part which is at a distance of 2 mm or more from the end face 104, and only the part near the hole at a distance of 2 mm or less from the end face 104 is locally softened. As a result, it can be seen that the product performance can be ensured without lowering the strength of the base material while improving the stretch-flangeability.

Figure 13:
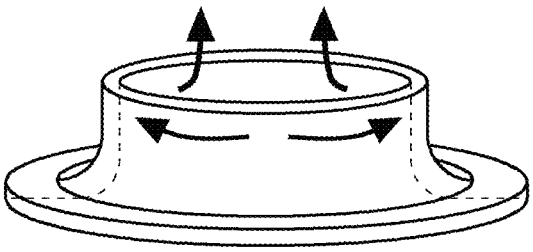
FIG. 13 shows a formed product including a stretch-flange forming part.
Figure 13:
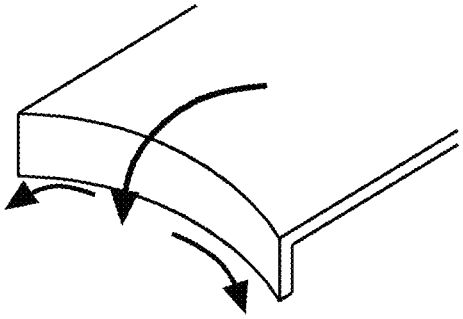

Next, an example of a formed product processed by the forming and processing method according to this embodiment will be described. The formed product formed by the forming and processing method according to this embodiment is, for example, as shown in FIG. 13, a formed product including a stretch-flange forming part such as a hole-expanding forming part for expanding a hole and a flange forming part for erecting a flange having curvature, and a is formed product including a formed part in which a line length of the end face is remarkably increased after the processing from before the processing.

Figure 14:
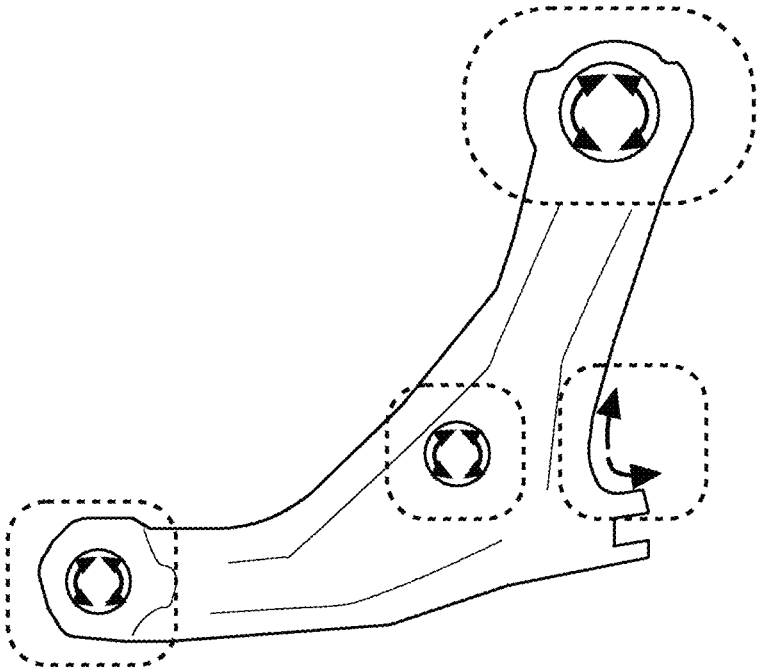
FIG. 14 shows a specific example of a formed product of an FR lower arm.

As a specific formed product, an FR lower arm used for a suspension of a vehicle is assumed as shown in FIG. 14. In FIG. 14, bush press-in parts surrounded by dotted lines, a hole-expanding forming part such as a working hole, and a flange forming part such as a crotch part may be formed by the forming and processing method according to this embodiment.

In the above forming method, the case where the hole 101 is formed in the steel plate 100 is described as an example, but the punching step of punching the steel plate 100 is not limited to the case where the hole 101 is formed, and instead an unnecessary part may be cut off. In the stretch-flange forming step, the flange die 300 is pressed against the punched end 103 from which an unnecessary part is cut off to form a stretch-flange. As described below, the flange forming parts of the A pillar lower and the B pillar outer lower are formed in this manner.

Figure 15:
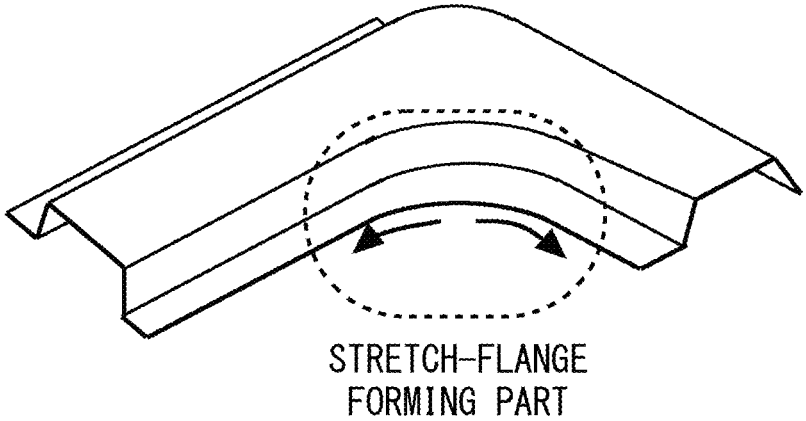
FIG. 15 shows a specific example of a formed product of an A pillar lower.

As the formed product, as shown in FIG. 15, an A pillar lower used for a window pillar of a vehicle is assumed. In FIG. 15, a flange forming part such as a corner part surrounded by a dotted line may be formed by the forming and processing method according to this embodiment.

Figure 16:
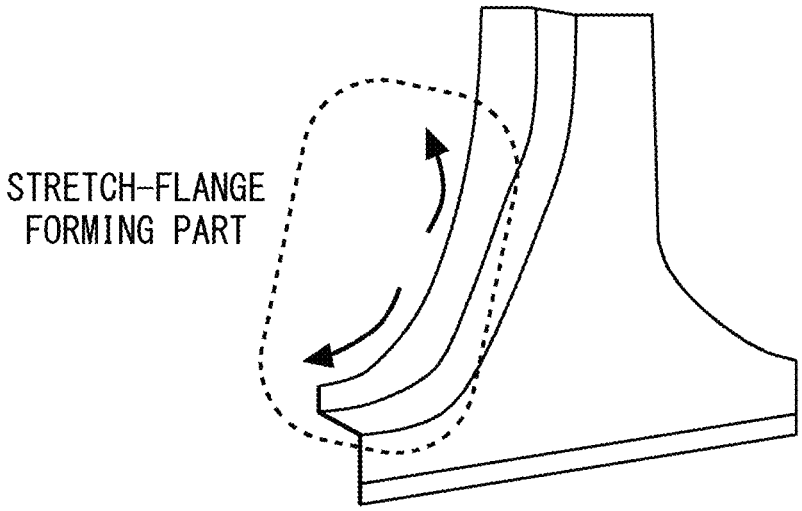
FIG. 16 shows a specific example of a formed product of a B pillar outer lower.

As another formed product, a B pillar outer lower of a vehicle is assumed as shown in FIG. 16. In FIG. 16, a flange forming part such as a corner part surrounded by a dotted line may be formed by the forming and processing method according to this embodiment.

The forming and processing method according to this embodiment includes the punching step of punching the steel plate 100, the heating step of disposing the heating coil 1 so as to face the end face 104 of the punched end 103 punched in the punching step in a non-contact manner along the end face 104, and applying a current to the heating coil 1 to generate an induced electromotive force in the steel plate 100, thereby heating the end face 104. Thus, only the punched end 103 can be locally heated while stabilizing the current value of the heating coil 1 during heating.

Second Embodiment

Figure 17:
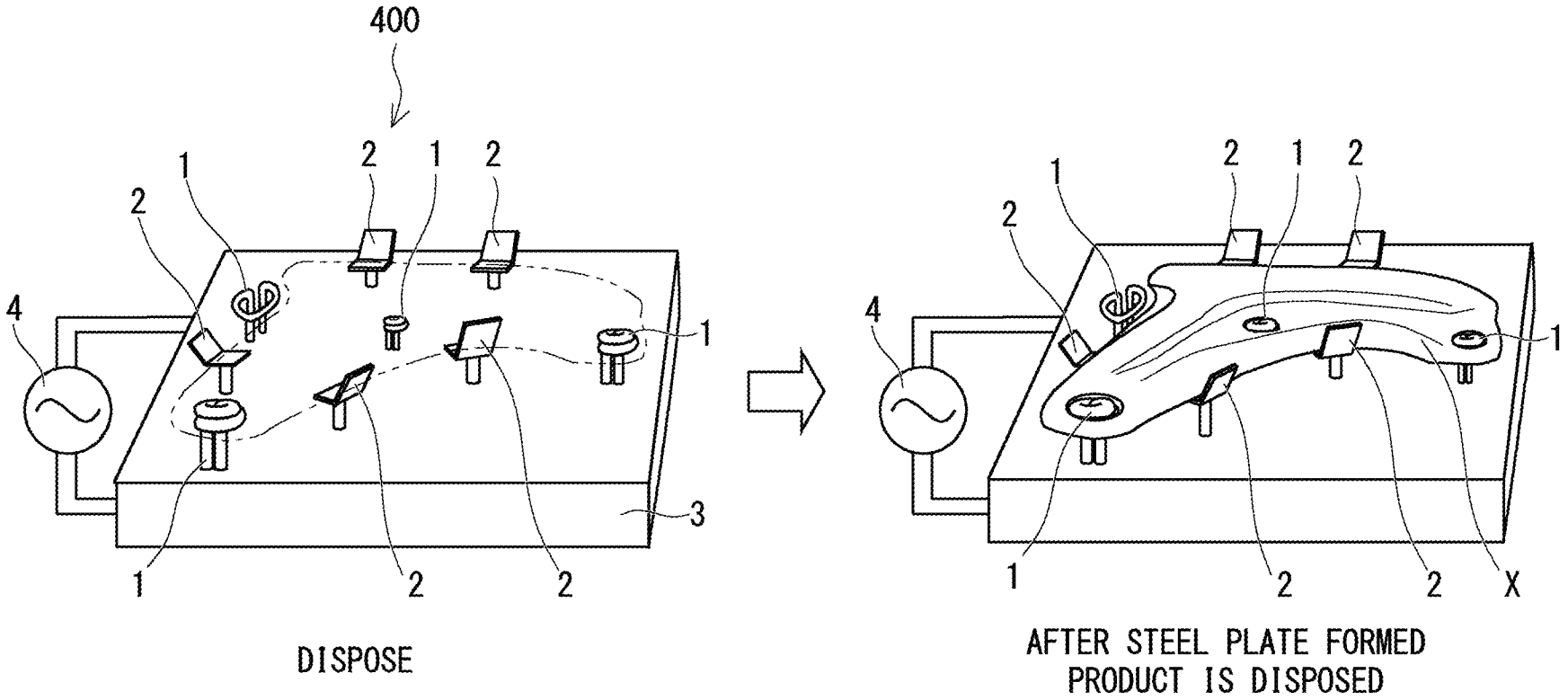
FIG. 17 shows an example of a heating jig.

In a second embodiment, a steel plate formed product punched in the punching step is placed on a heating jig in the heating step and then heated. FIG. 17 shows an example of the heating jig. A left side view of FIG. 17 shows a state before a steel plate formed product X is disposed on a heating jig 400, and a right side view of FIG. 17 shows a state after the steel plate formed product X is disposed on the heating jig 400.

As shown in FIG. 17, the heating jig 400 includes heating coils 1 for heating the punched end 103 of the steel plate formed product X, positioning guides 2 for positioning the steel plate formed product X at a predetermined position, and a base part 3. An AC power supply 4 for supplying power to each heating coil 1 is connected to each heating coil 1.

The shape and arrangement of the positioning guides 2 are set so that the position of the steel plate formed product X is automatically set only by placing the steel plate formed product X on the positioning guides 2. The heating coils 1 and the positioning guides 2 are arranged on the base part 3 corresponding to the shape of the steel plate formed product X and the position of a part to be heated.

The positions, number, and shapes of the heating coils 1 are not limited to the example shown in FIG. 17, and can be set in any way. Similarly, the positions, number, and shapes of the positioning guides 2 are not limited to the example shown in FIG. 17, and can be set in any way.

By using the heating jig 400 according to this embodiment, it is not necessary to heat the steel plate formed product X from the vertical direction while holding the steel plate formed product X as in the related art. Instead, by using the heating jig 400 according to this embodiment, the steel plate formed product X can be easily disposed on the heating jig 400 and heated.

Figure 18:
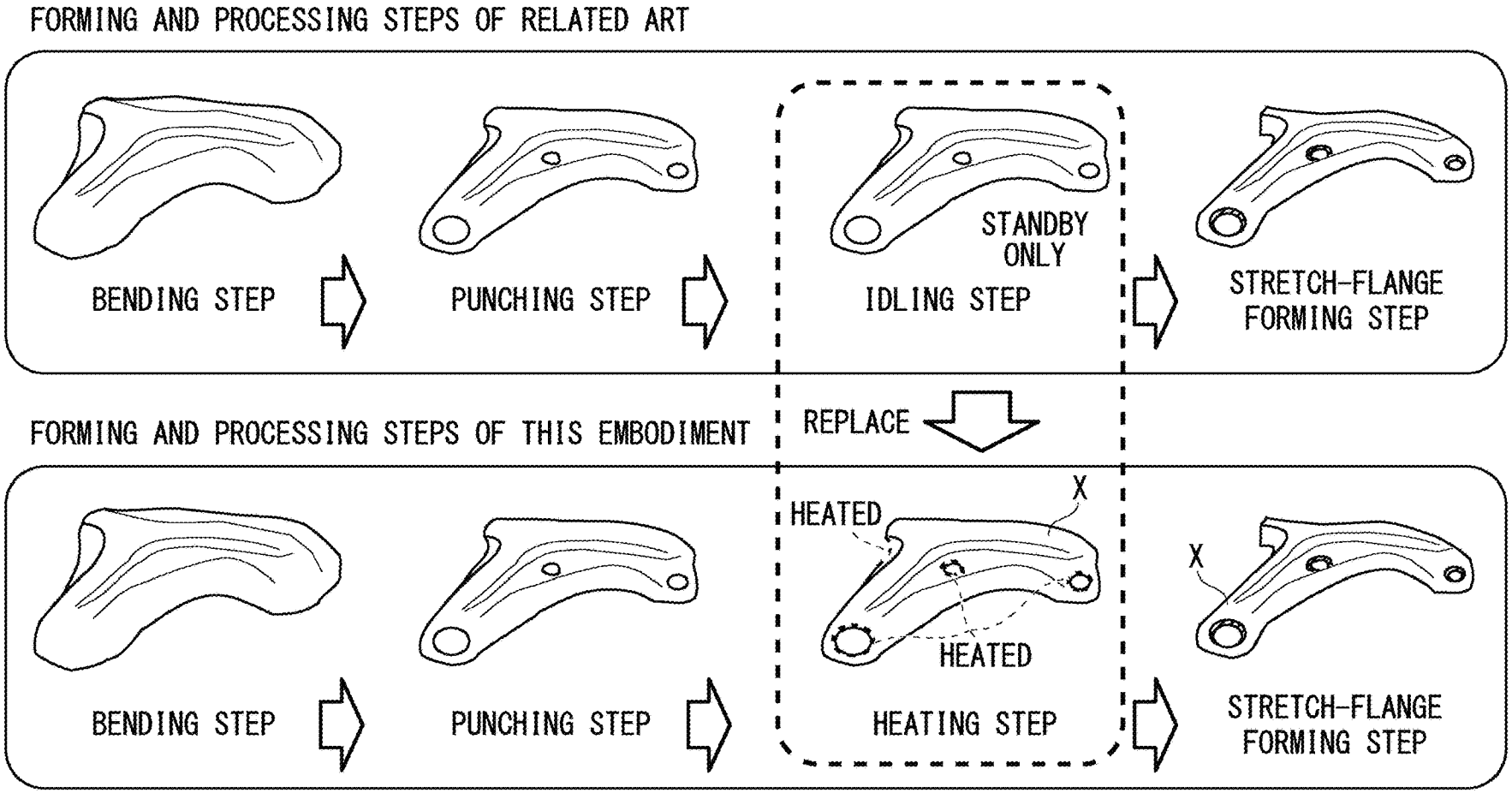
FIG. 18 is a diagram for comparing steps of the forming and processing method according to this embodiment with steps of a forming and processing method according to related art.

As shown in FIG. 18, the heating step according to this embodiment may be carried out in an idling step between the punching step and the stretch-flange forming step. The idling step is a step for adjusting a conveying pitch when the steel plate formed product X is conveyed from the punching step to the stretch-flange forming step, and is a standby step in which no processing is performed.

Thus, the steel plate formed product X can be efficiently heated by utilizing the idling step in which, in the related art, the punched steel plate formed product X is placed on standby after the punching step and before the stretch-flange forming step. Since it is not necessary to introduce an additional heating step, productivity is improved.

Figure 19:
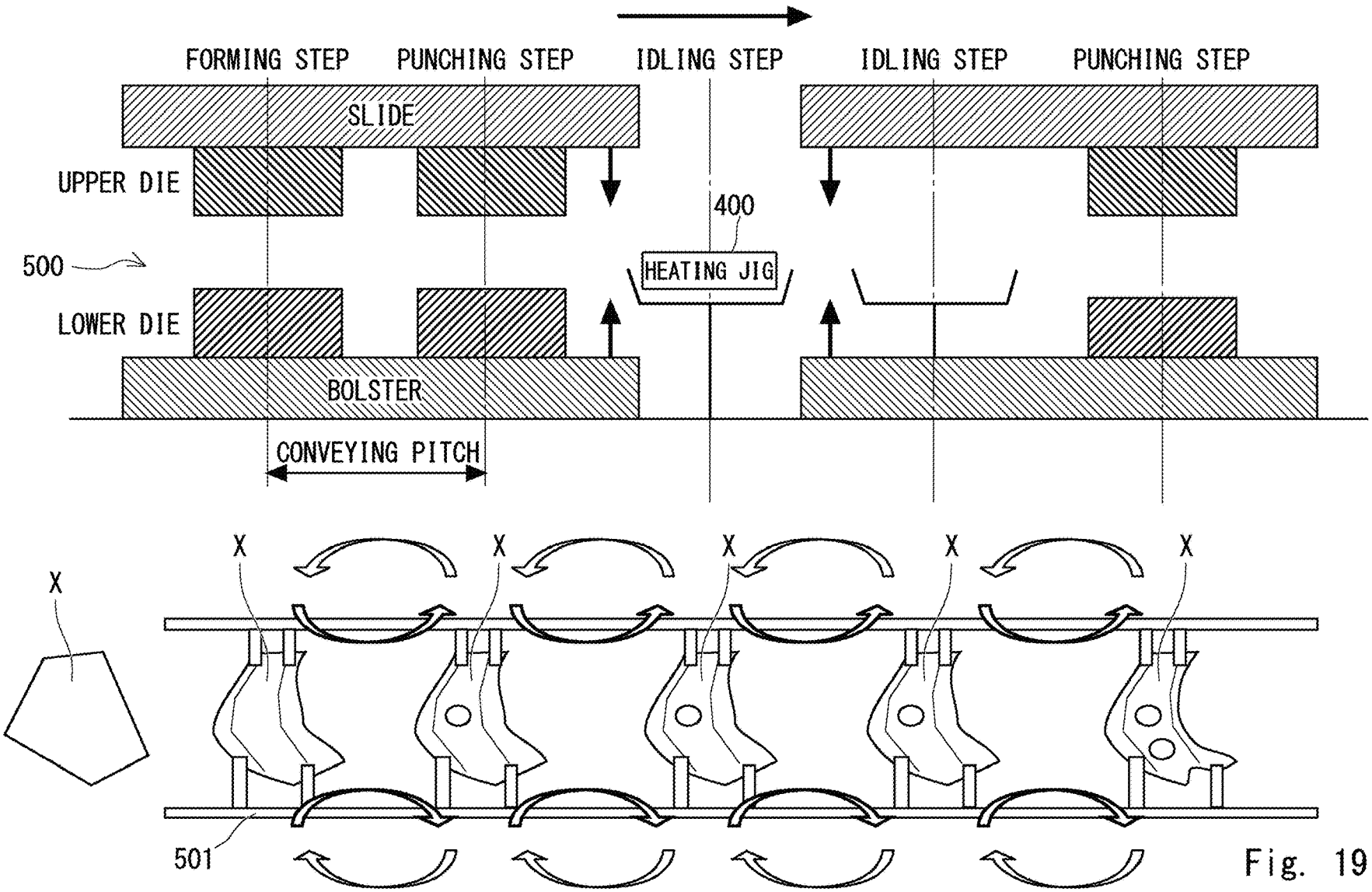
FIG. 19 shows an example of steps in a press machine.

Further, according to this embodiment, since the heating jig 400 can be easily disposed in the idling step in a normal press machine, the idling step can be converted into the heating step, so that the number of steps is not increased. FIG. 19 is a schematic diagram showing an example of steps in a press machine.

In a press machine 500, for example, while the steel plate formed product X is continuously conveyed by the fingers (gripping parts) 501 shown in the lower part of FIG. 19, the molding step, the punching step, the idling step, the idling step, and the punching step shown in the upper part of FIG. 19 are continuously performed at a predetermined conveying pitch. Thus, the idling step in the press machine 500 can be easily replaced with the heating step by simply placing the heating jig 400 at a position corresponding to the idling step.

The heating step may be carried out during an optional step in the press machine 500, for example, the forming step or the punching step, if the heating jig 400 can be disposed.

Although several embodiments of the disclosure have been described, these embodiments are presented by way of example and are not intended to limit the scope of the disclosure. These new embodiments may be implemented in various other forms, and various omissions, substitutions, and modifications may be made without departing from the spirit and scope of the disclosure. These embodiments and modifications thereof are included in the scope and the gist of the disclosure, and are also included in the scope equivalent to the claimed disclosure.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A forming and processing method comprising:

punching a steel plate; and disposing a heating coil so as to face an end face of a punched end punched in the punching in a non-contact manner along the end face of the punched end and applying a current to the heating coil to generate an induced electromotive force in the steel plate, thereby heating the end face, wherein a hole is formed in the steel plate by punching the steel plate in the punching, and in the heating, an end face of the hole is heated while the heating coil is inserted into the hole, and wherein the heating coil is formed in a loop shape along an end face formed on the steel plate, and end parts of the loop shape overlap each other.

2. The forming and processing method according to claim 1, wherein a diameter of the heating coil is larger than a thickness of the steel plate.

3. The forming and processing method according to claim 1, wherein in the punching, an open punched end including an end face partially opened is formed in the steel plate by punching the steel plate, and in the heating, the heating coil is disposed so as to face an end face of the open punched end along the end face of the open punched end, and then the end face of the open punched end is heated.

4. The method according to claim 1, wherein in the heating, the steel plate punched in the punching is disposed on a heating jig and then heated by the heating coil, and the heating jig includes a positioning guide for positioning the steel plate punched in the punching at a predetermined position, and the heating coil for heating the end face of the punched end of the steel plate positioned by the positioning guide.

5. The method according to claim 1, wherein the number of windings of the heating coil is three.

6. The method according to claim 1, wherein a center axis of the heating coil is inclined at a predetermined angle with respect to a center axis of the end face of the punched end of the steel plate, and the predetermined angle $\theta$ is set within a range of $-15° \leq \theta \leq 15°$.

7. The method according to claim 1, wherein the heating coil is formed as a single coil wire, and a cooling liquid flows in the heating coil.

8. The method according to claim 7, wherein the heating coil is pipe-shaped.

* * * * *